US011523957B2

(12) United States Patent
Lee et al.

(10) Patent No.: US 11,523,957 B2
(45) Date of Patent: Dec. 13, 2022

(54) PATIENT TRANSFER SYSTEM

(71) Applicants: Ka Shek Neville Lee, Sai Kung (HK); Sing-Kwong Samuel Hui, Mid-levels (HK)

(72) Inventors: Ka Shek Neville Lee, Sai Kung (HK); Sing-Kwong Samuel Hui, Mid-levels (HK)

( * ) Notice: Subject to any disclaimer, the term of this patent is extended or adjusted under 35 U.S.C. 154(b) by 0 days.

(21) Appl. No.: 17/019,290

(22) Filed: Sep. 13, 2020

(65) Prior Publication Data

US 2020/0405558 A1 Dec. 31, 2020

Related U.S. Application Data

(63) Continuation of application No. PCT/CN2019/077860, filed on Mar. 12, 2019.

(60) Provisional application No. 62/642,607, filed on Mar. 14, 2018.

(51) Int. Cl.
*A61G 7/16* (2006.01)
*A61G 7/10* (2006.01)

(52) U.S. Cl.
CPC ..... *A61G 7/165* (2016.11); *A61G 7/103* (2013.01); *A61G 7/109* (2013.01); *A61G 7/1026* (2013.01); *A61G 7/1028* (2013.01); *A61G 7/1042* (2013.01); *A61G 7/1059* (2013.01); *A61G 7/1088* (2013.01)

(58) Field of Classification Search
CPC .. A61G 7/1025; A61G 7/1026; A61G 7/1034; A61G 7/1028; A61G 7/165
See application file for complete search history.

(56) References Cited

U.S. PATENT DOCUMENTS 5,651,149 A * 7/1997 Garman ..... A61G 5/1059 414/921
6,829,794 B2 * 12/2004 Lenyo ..... A47G 9/10 128/845
8,950,776 B2 * 2/2015 Tsukada ..... A61G 7/16 280/30
2012/0124744 A1 * 5/2012 Hornbach ..... A61G 7/16 5/613
2013/0074256 A1 * 3/2013 Tsukada ..... A61G 7/0513 5/81.1 R
2014/0202557 A1 * 7/2014 Bullin ..... A61G 5/1045 137/224

(Continued)

FOREIGN PATENT DOCUMENTS

CN 107714353 A * 2/2018
GB 2562039 A * 11/2018 ..... A61G 7/1021
WO WO-2017085445 A1 * 5/2017 ..... A61G 7/1059

*Primary Examiner* — Robert G Santos
*Assistant Examiner* — Adam C Ortiz

(57) ABSTRACT

Disclosed is a patient transfer system for transferring a user between a bed and a purposefully designed mobile sitting device that is aligned and berthed alongside the bed, wherein, the bed is adaptable to a seated arrangement and includes an interleaf structure of cushions and platforms, the platform including: a padding, a rail, restricted path, or track, and means for transferring the padding in a direction parallel to the ground away or towards the bed; the bed further includes means to raise or lower the top of the cushions or the padding; and the mobile sitting device includes a receiving rail, restricted path or track to receive the padding.

17 Claims, 13 Drawing Sheets

(56) References Cited

U.S. PATENT DOCUMENTS

| | | | | |
|---|---|---|---|---|
| 2014/0306429 | A1* | 10/2014 | Patterson | A61G 7/0528<br>280/657 |
| 2018/0214330 | A1* | 8/2018 | Cooper | A61G 5/1075 |
| 2019/0059606 | A1* | 2/2019 | Huang | A63B 21/4037 |
| 2020/0146912 | A1* | 5/2020 | Gillespie | A61G 7/16 |

* cited by examiner

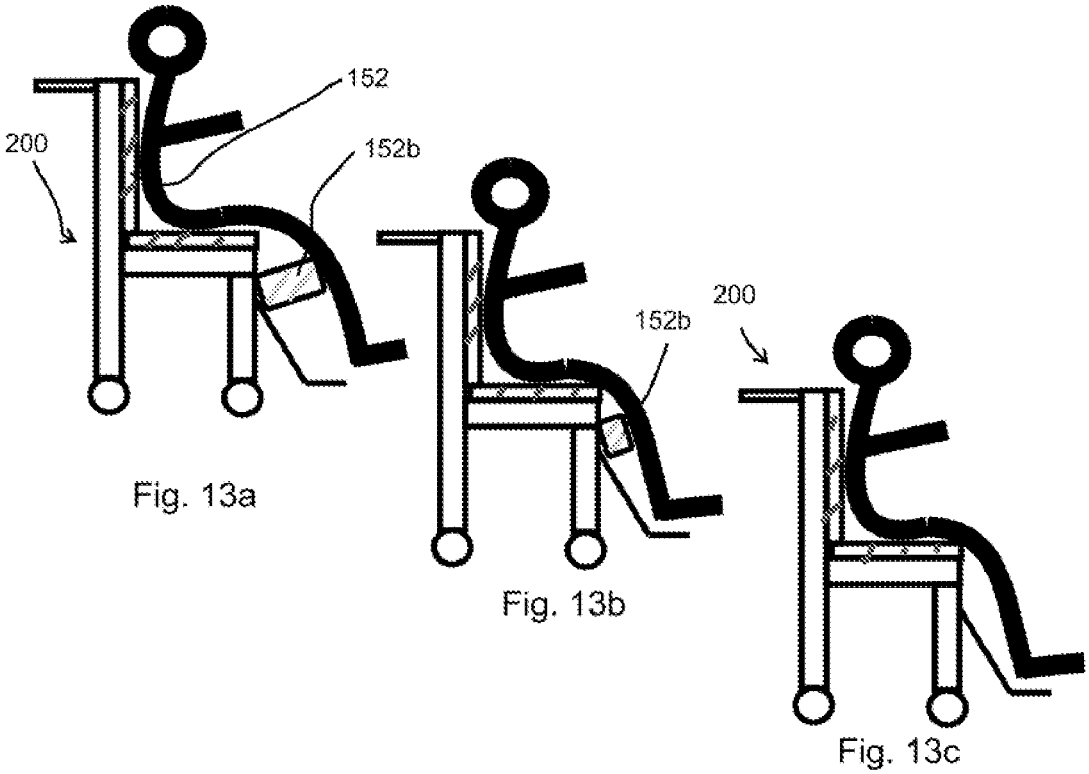
Fig. 13a
Fig. 13b
Fig. 13c
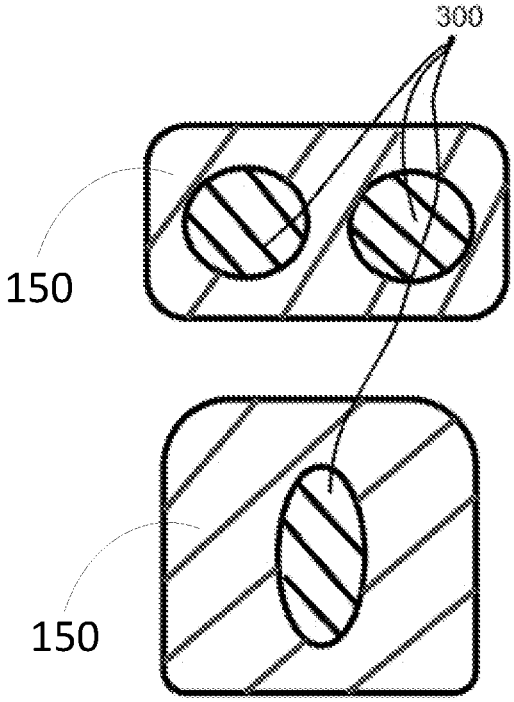
Fig. 14a

PATIENT TRANSFER SYSTEM

CROSS-REFERENCE TO RELATED APPLICATION

This application claims the benefit of U.S. provisional application No. 62/642,607, filed on Mar. 14, 2018, titled "Patient Transfer System". The entire disclosure of the above-referenced application is incorporated herein by reference in entirety for all purpose.

TECHNICAL FIELD

The present disclosure relates to a system for transferring a user between a bed and a purposefully designed wheelchair.

BACKGROUND

Society is facing an aging crisis in which there are not enough caretakers to take care of the elderly. One of the biggest challenges for elderly is mobility. While there are electric wheelchairs to take care of many of the mobility issues, transferring from the bed to the wheelchair or a shower chair often still requires a lot of external help.

Thus, in a society where a caretaker may not be readily available, simplifying or automating the patient transfer process is a huge priority.

In the prior art there exists many examples of cranes or transfer mechanisms such as the conveyor belt system in U.S. Pat. No. 8,690,178B2. In this example, they use a complicated conveyor belt that can pivot upward to support the back and be slowly used to transport the user down the bed. Not only will this method cause unacceptable and dangerous chafing of the skin due to rubbing and friction, it is likely to be expensive, and require a fair bit of outside intervention. For example, if the conveyor belt does not fully move the person onto the wheelchair, the raising of the mid-part of the bed could dump the user onto the ground. Moreover, this prior art would require a lot of space (lengthwise and vertically) and would dump the contents of a bed all over the place. In short, it would be unpractical and potentially dangerous.

A more typical transfer mechanism is the patient lift or hoist used in US20050217024A1 and which requires outside help to put on the harness and seep under the person to be hoisted. After hoisting the user, a helper or caretaker would need to move the crane or hoist to the intended location or device before lowering the patient again and pulling the hoist out from underneath. This solution, while it alleviates the burden of lifting from the user, still requires a lot of outside intervention and is relatively expensive and space hogging.

The system in U.S. Pat. No. 5,839,134 introduces another type of bed to wheelchair system, which uses an interleaf system to detach a frame from the bed using a series of lifting apparatus. The shortcoming of this system is that the lifting apparatus must be large and strong, to support lifting the user and a large frame up and out of the bed and rearward over the bedframe before carefully lowering the user and frame onto a separate. The size of this humongous lifting apparatus makes the device impractical from a space-usage perspective and the design expensive to implement. Moreover, the potential for misuse is large and thus would likely require external help and adjustment to operate the lifting apparatus to ensure alignment is perfect.

Besides, there is also a desire for the wheelchair or shower chair to be practical for regular, normal use. For example, a wheelchair should not be too bulky and a shower chair or commode should have a seat opening for the toilet.

SUMMARY

Thus, the motivations for this disclosure include: minimizing or removing the need for external assistance during the transfer process; providing a solution that prevents chafing of the skin during transfer, is not bulky, so as to hinder maneuverability, and is reasonably inexpensive to manufacture.

It is also the intention of this disclosure to introduce a system for patient transfers that can be done automatically, safely and with little or no caretaker assistance.

In order to achieve the above-mentioned motivations, embodiments of the present disclosure provide a patient transfer system for transferring a user between a bed and a purposefully designed mobile sitting device that is aligned and berthed alongside the bed, wherein, the bed is adaptable to a seated arrangement and includes an interleaf structure of cushions and platforms, the platform including: a padding, a rail, restricted path or track, and means for transferring the padding in a direction parallel to the ground away or towards the bed; the bed further includes means to raise or lower the top of the cushions or the padding; and the mobile sitting device includes a receiving rail, restricted path or track to receive the padding.

According to the above-mentioned patient transfer system, in a first state, an interleaf structure is arranged to create a relatively uniform or level top surface between the cushions and the top of the padding which together form a mattress for the bed. A second state involves creating a gap in elevation such that the top of the padding is above the top of the cushions. The top of the padding supports the weight of the user above the cushions allowing him/her to be transferred sideways while minimizing any friction against the cushions.

The user along with the padding are then pushed or moved along a pre-defined track (or restricted path) to the mobile sitting device before being locked or secured in place. Preferably this pushing or pulling is done automatically and the pushing/pulling means is retracted afterwards.

It should be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

FIGS. 13*a* to 13*c* illustrate the change of the angle, size or position of the padding according to an exemplary embodiment;

FIGS. 14*a* to 14*c* depict the process of lowering the inlays according to an exemplary embodiment;

DETAILED DESCRIPTION

Figure 1:
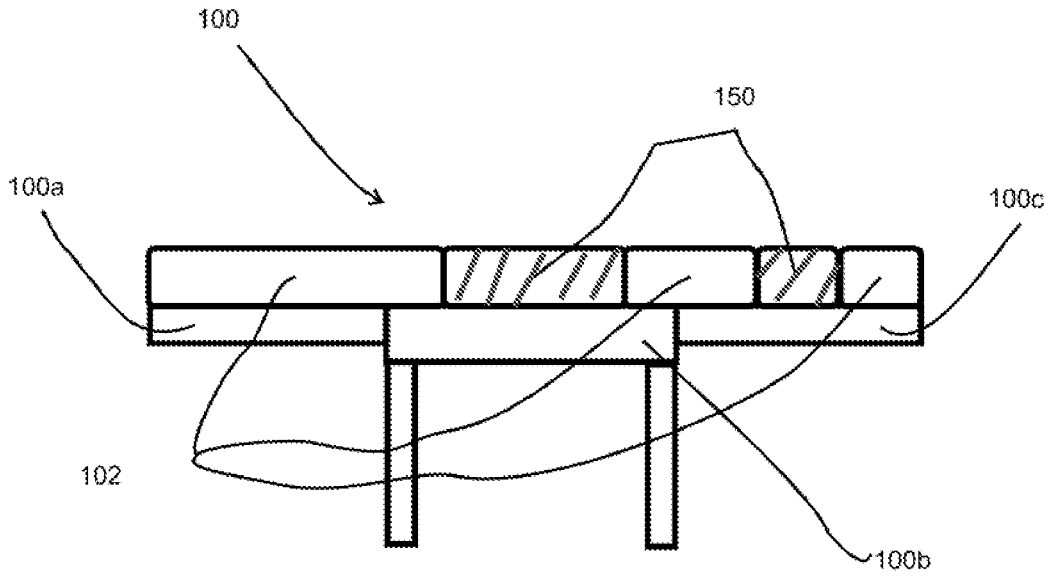
FIG. 1 is a schematic view of a bed arranged in a fully reclined position with the top of its cushions are fully level with that of its platforms/paddings according to an exemplary embodiment.

The current disclosure involves a patient transfer system for transferring between a bed 100 and a purposefully designed mobile sitting device 200 such as a wheelchair, mobile shower chair or commode. Preferably the bed 100 is adaptable into a sitting position for ease of alignment and includes an interleaf structure of cushions 102 and platforms 150, the platform 150 further including a detachable padding at its top 152, a rail, restricted path or track 154, and means 156 for transferring the padding and user in a direction parallel to the ground along the track. The wheelchair also contains a matching rail, restricted path or track 254 and alignment features for correct berthing with the bed.

Preferably the bed 100 includes an upper portion 100*c* for supporting the upper body of the user, a middle portion 100*b* for supporting the middle portion or buttocks section of the user and a lower portion 100*a* for supporting the legs and feet. The mobile sitting device 200 similarly includes an upper portion 200*c* for supporting the upper body of the user, a middle portion 200*b* for supporting the middle portion or buttocks section of the user and a lower portion 200*a* for supporting the legs and feet In FIG. 1 the interleafing structure has platforms 150 and cushions 102 arranged side-by-side in a fully reclined position such that the top of its cushions 102 are fully level with the top of the platforms 150/paddings 152.

Figure 2:
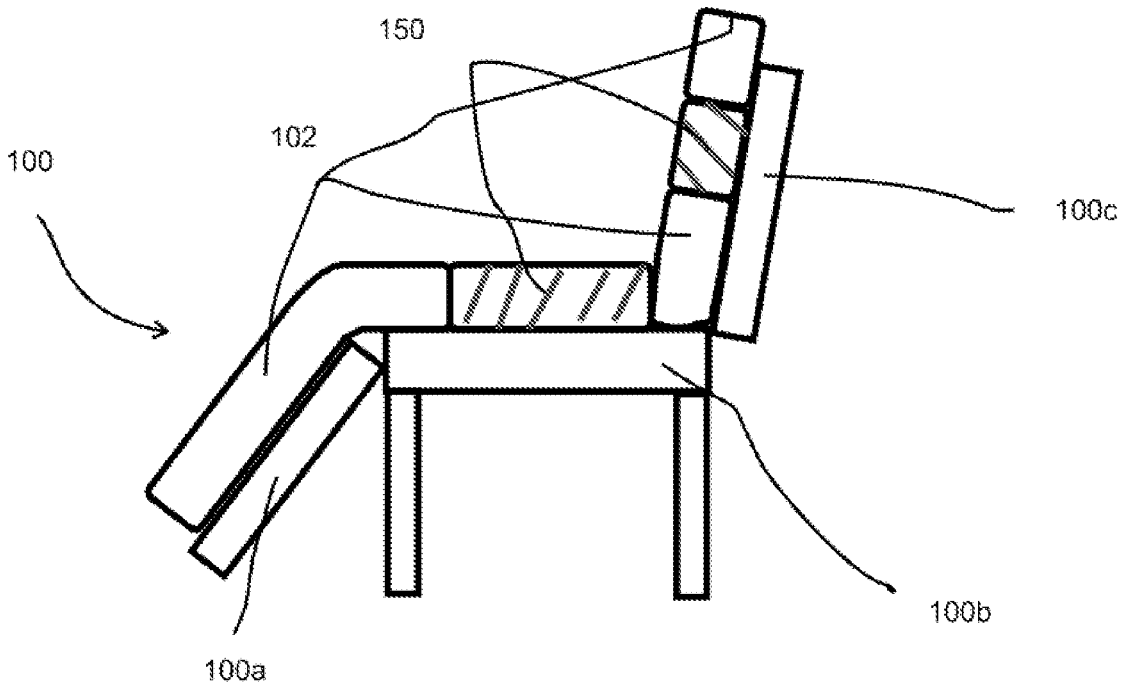
FIG. 2 is a schematic view of the bed arranged in a regular upright sitting surface with the top of its cushions maintaining a relative uniform top level with that of the platforms/paddings according to an exemplary embodiment.

In FIG. 2, the bed 100 is arranged in a regular upright sitting surface with the top of its cushions 102 maintaining a relative uniform top level with that of the platforms 150/paddings 152 in a shape that reflects a regular chair or couch. In this figure, the lower portion 100*a* bends downward and the upper portion 100*c* bends upwards.

Figure 3:
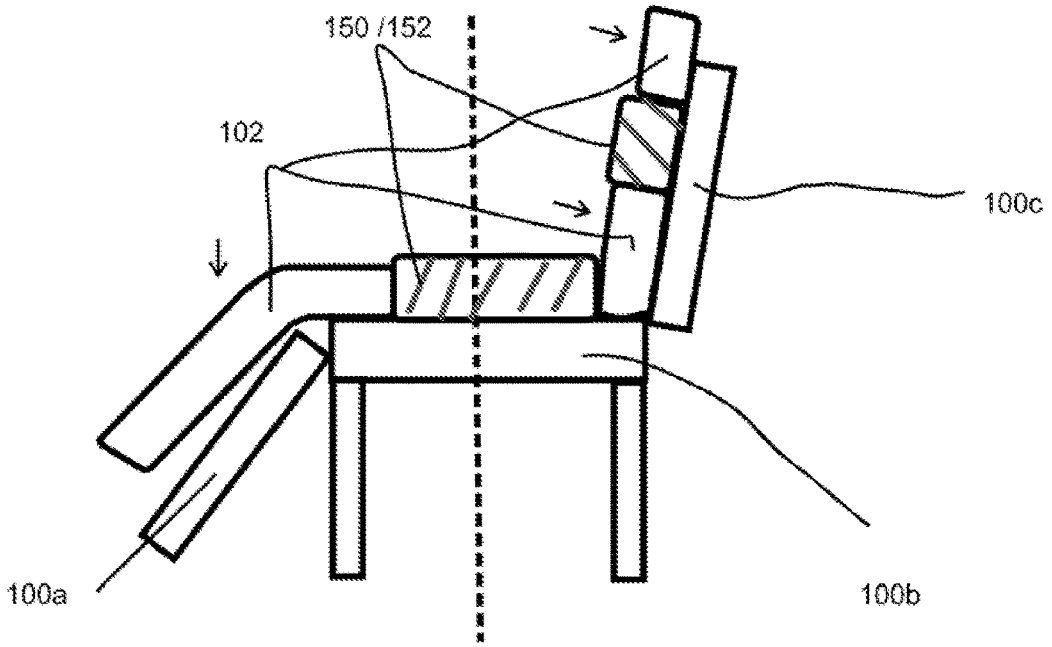
FIG. 3 is a schematic view of the bed arranged in an upright sitting position with the cushion structures contracting or lowering relative to the platforms/paddings according to an exemplary embodiment.
Figure 4:
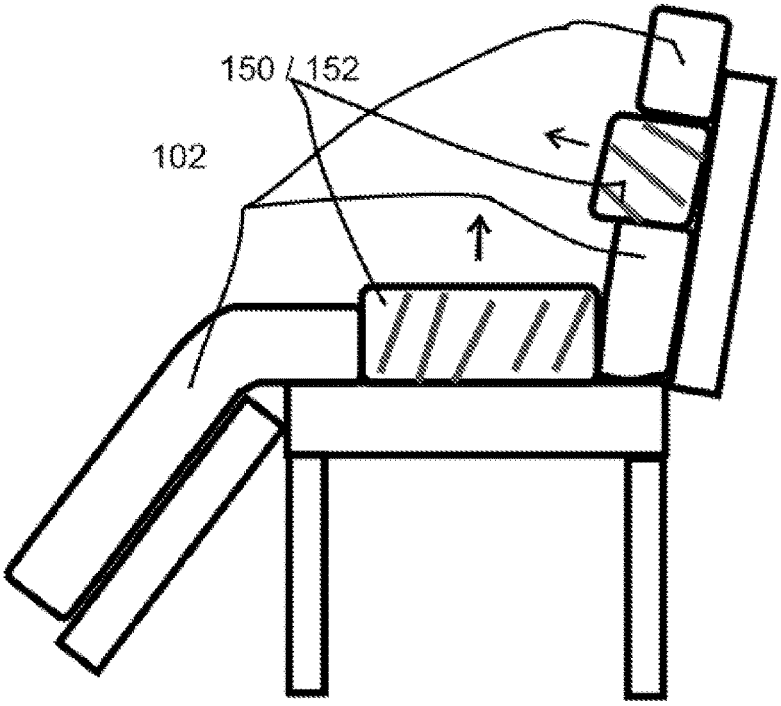
FIG. 4 is a schematic view of the bed arranged in an upright sitting position with the paddings raised or expanding relative to the cushions according to an exemplary embodiment.

In FIGS. 3 and 4 the bed 100 is arranged in an upright sitting position with the top of the padding 152 raised relative to the top of the cushions.

In FIG. 3, the embodiment shows the cushion structures 102 contracting or lowering relative to the platforms 150/paddings 152. In FIG. 4, an alternative embodiment shows the paddings 152 raised or expanding relative to the cushions 102.

Figure 5A:
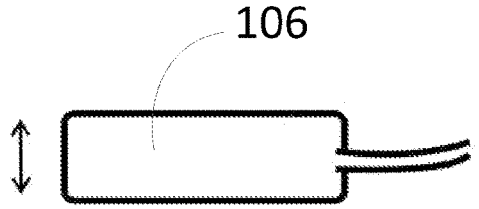
FIG. 5*a* is a schematic view of an air cushion being expanded according to an exemplary embodiment.
Figure 5B:
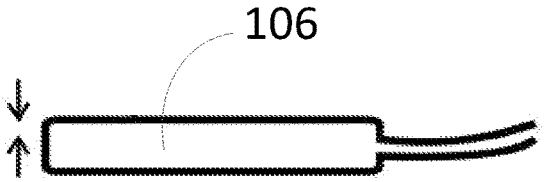
FIG. 5*b* is a schematic view of the air cushion as shown in FIG. 5*a* being contracted according to the exemplary embodiment.
Figure 5C:
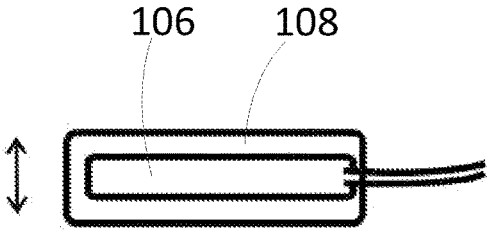
FIG. 5*c* is a schematic view of another air cushion being expanded according to an exemplary embodiment.
Figure 5D:
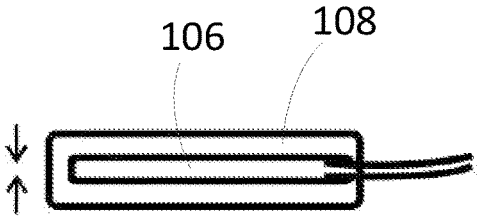
FIG. 5*d* is a schematic view of the air cushion as shown in FIG. 5*c* being contracted according to the exemplary embodiment.

Optionally the cushion 102 or padding 152 includes an air cushion 106. The air cushion 106 is expanded in FIGS. 5*a* and 5*c* and contracted in FIGS. 5*b* and 5*d*, which can be used to raise and lower the top surface of the cushions 102 or paddings 152 respectively. The air cushions 106 in FIGS. 5*c* and 5*d* are preferably embedded in a layer of foam or other soft filling 108. Alternatively, the cushions 102 or paddings 152 can be raised or lowered through the use of a motor or piston (not shown).

Figure 6:
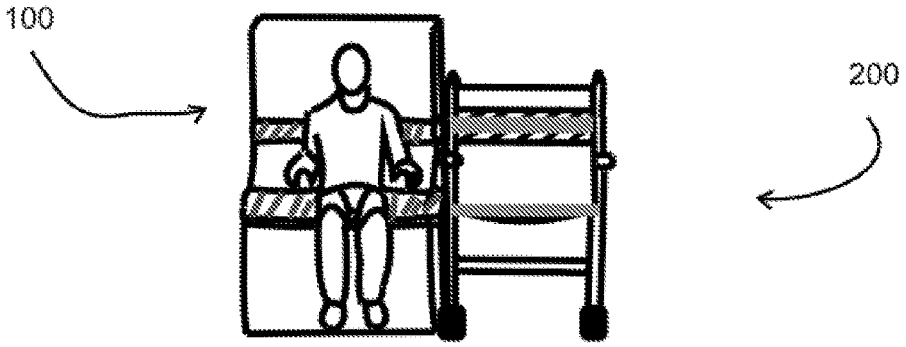
FIG. 6 is a schematic view showing that the mobile sitting device is aligned or berthed alongside the reclining bed according to an exemplary embodiment.

Prior to attempting a transfer, the mobile sitting device 200 is aligned or berthed alongside the reclining bed 100 as in FIG. 6. Preferably, an alignment mechanism 110 is used to ensure that the mobile sitting device 200 is berthed properly beside the reclining bed within a certain range of tolerance.

Figure 7A:
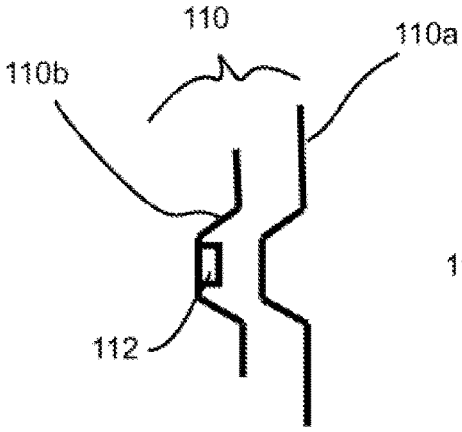
FIG. 7*a* depicts an alignment mechanism being apart according to an exemplary embodiment.
Figure 7B:
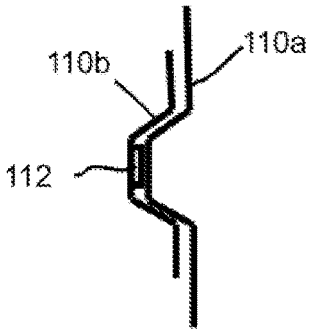
FIG. 7*b* depicts the alignment mechanism as shown in FIG. 7*a* being inserted snuggly according to another exemplary embodiment.

As depicted in FIGS. 7*a* and 7*b*, optionally the alignment mechanism 110 includes male section 110*a* and female section 110*b* found on the mobile sitting device 200 and bed 100 respectively. Preferably the female section 110*b* of an alignment mechanism has a tapered design such that the male section 110*a* can be inserted snuggly in so as to ensure a consistent position. When the male section 110*a* is snuggly berthed with the female section 110*b*, indicating that the mobile sitting device is properly positioned beside the bed 100, it preferably sets off or pushes the sensor 112.

Figure 8A:
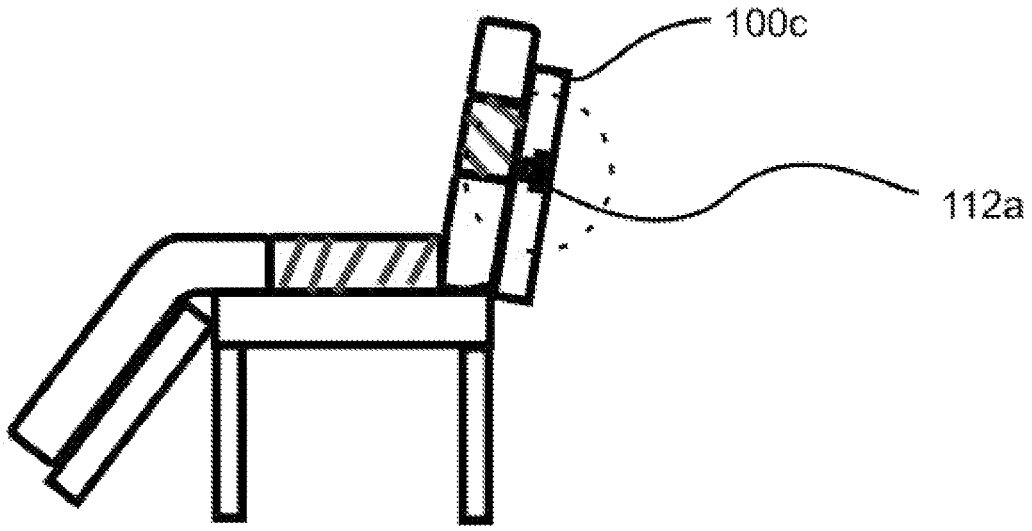
FIGS. 8*a*, 8*b* and 8*c* illustrate a potential alignment mechanism for the back of the bed according to an exemplary embodiment.
Figure 8B:
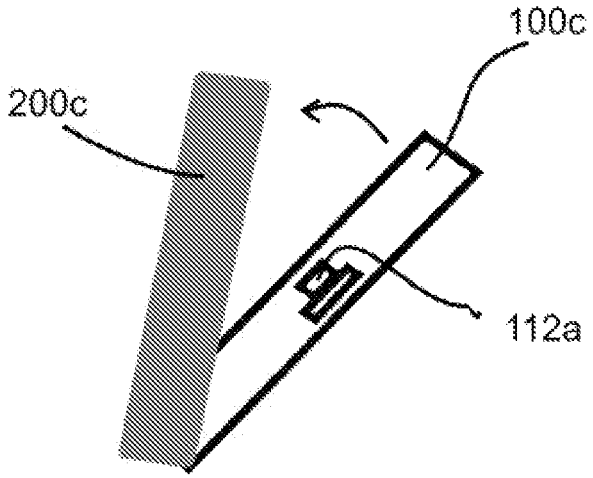
Figure 8C:
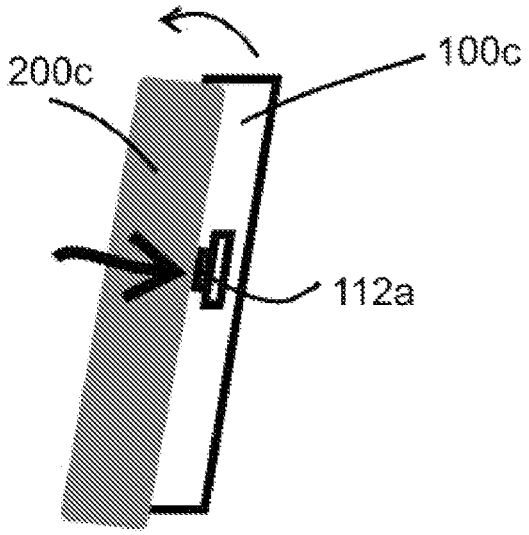

FIGS. 8*a*, 8*b* and 8*c* illustrate a potential alignment mechanism for the back of the bed 100. In 8*a*, a bed is depicted with a sensor 112*a* mounted on a side of the upper portion of the bed 100*c*. When the upper portion of the bed 100*c* rotates upward from a reclined position into a sitting position, it comes into contact with a part of the upper portion of the mobile sitting device 200*c*. This activates the sensor or button 112*a* indicating that the bed 100 is properly aligned and that the raising of the upper portion 100*c* can stop.

For example, in one embodiment if the shape of the bed is not configured or arranged in a manner that is aligned to the mobile sitting device, it is adjusted until it hits the limiter or the sensor indicates the alignment is correct. For safety purposes preferably the transfer can only begin when the sensors indicate alignment is correct.

Figure 9:
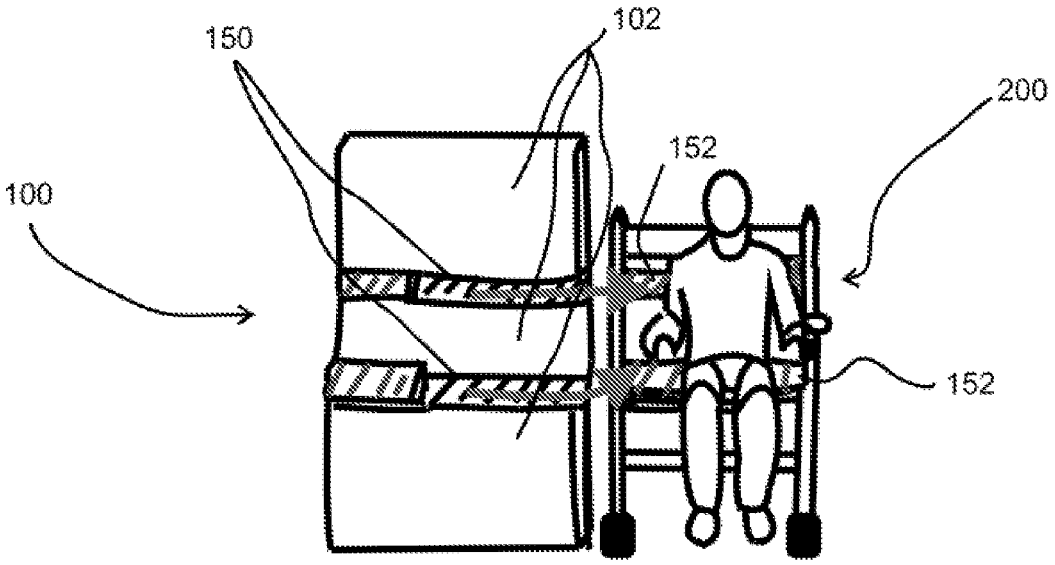
FIG. 9 illustrates a user being transferred horizontally carried by the paddings along the tracks of the bed to the mobile sitting device according to an exemplary embodiment.
Figure 10A:
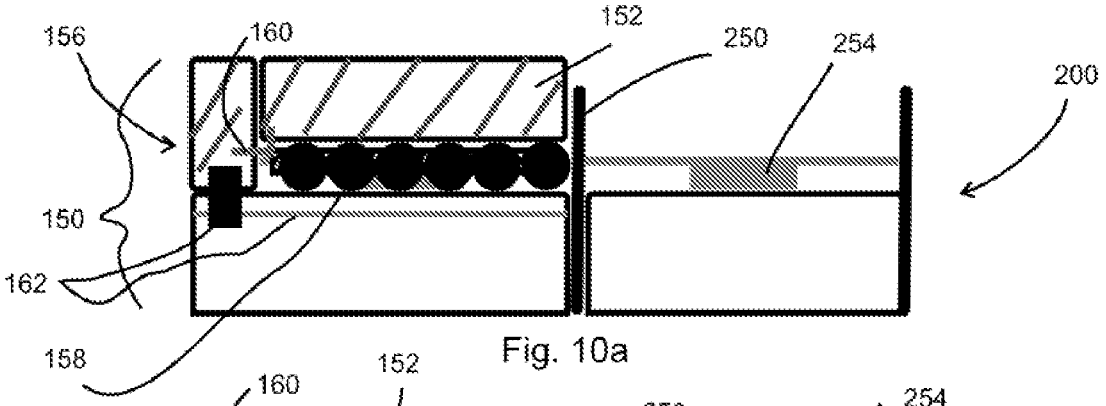
FIGS. 10*a* to 10*h* depict an example of a platform and transfer mechanism according to an exemplary embodiment.
Figure 10B:
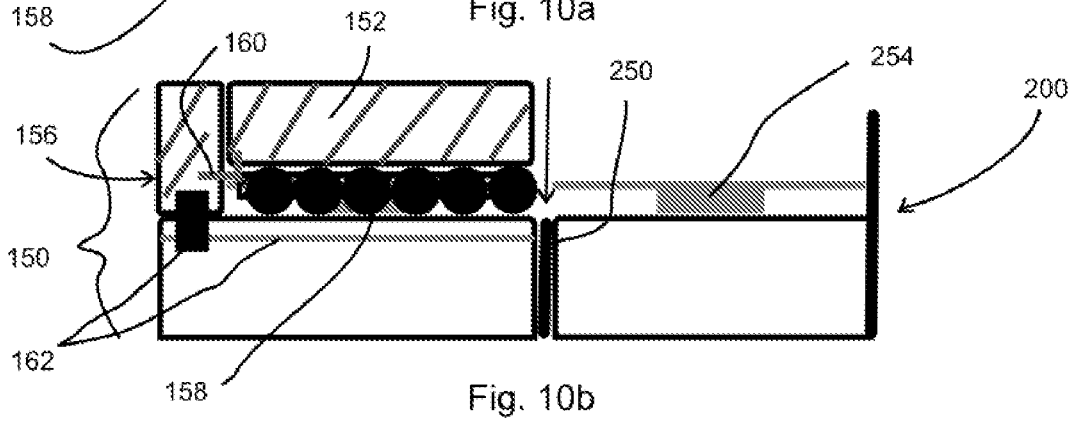
Figure 10C:
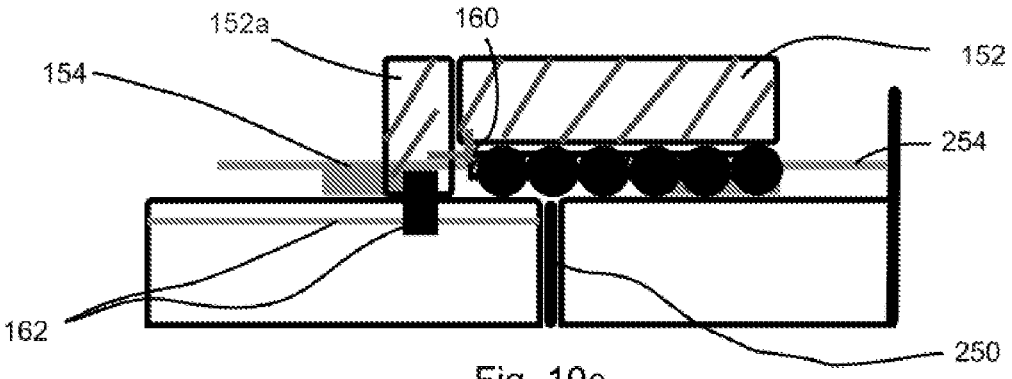
Figure 10D:
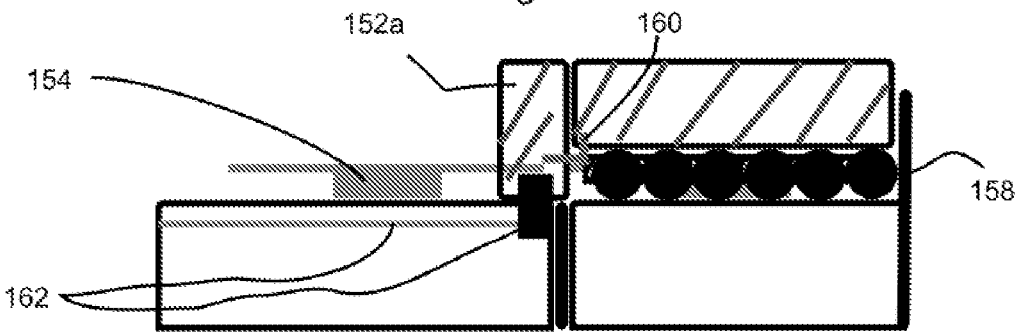
Figure 10E:
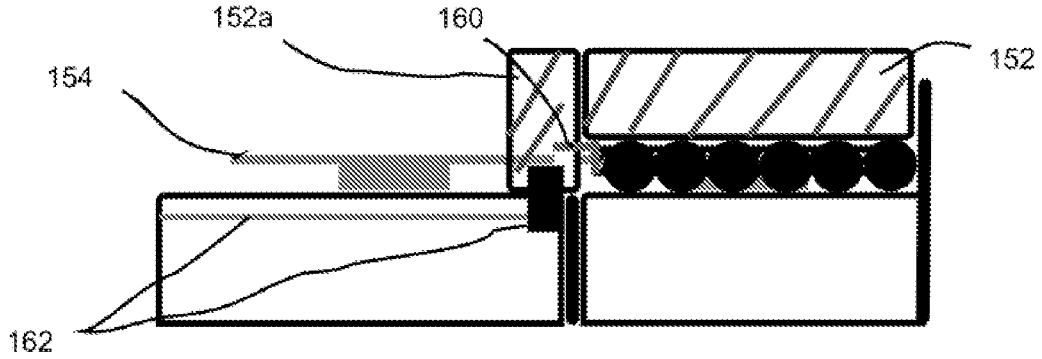
Figure 10F:
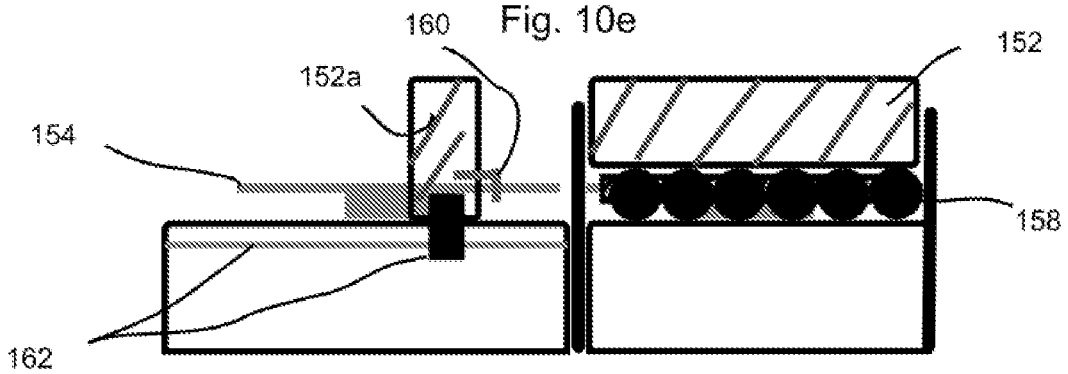
Figure 10G:
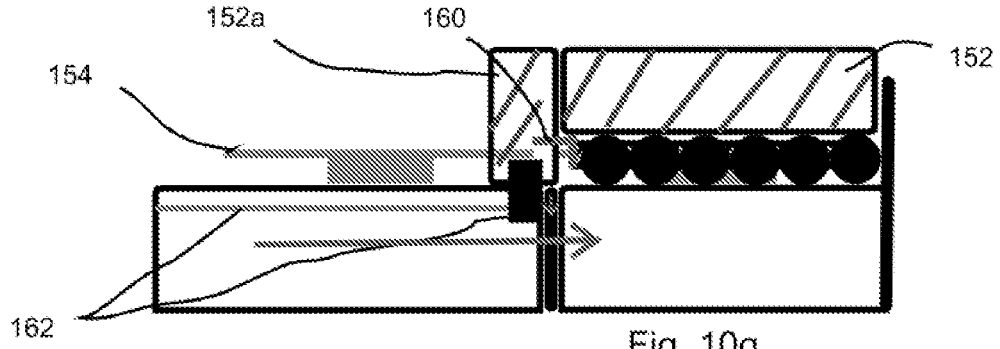
Figure 10H:
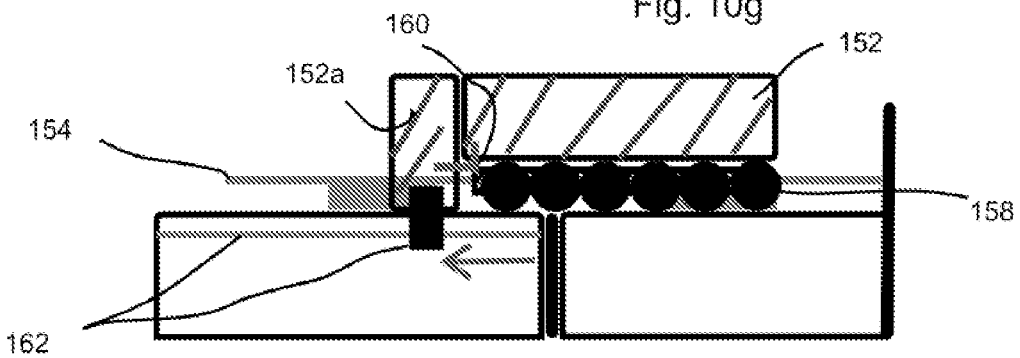

Subsequently, after berthing and alignment are indicated to be complete, the mobile sitting device 200 is preferably locked in place or locked to the bed 100. The transfer process then begins with the gap in elevation created between the platforms 150/paddings 152 and cushions 102 as in FIG. 3 or 4. As in FIG. 9, the user can then be transferred horizontally (or parallel to the ground), carried by the paddings 152, or a portion of it, along the tracks 154 of the bed 100 to the mobile sitting device 200 (which also has tracks 254).

An example or more detailed depiction of the platform 150 and means for transfer 156 are depicted in FIGS. 10 and 11. A platform 150 consists of padding 152, a track 154 and a means 156 for transferring the padding 152 to the tracks 254 of the mobile sitting device 200. Preferably the platform includes wheels 158.

In the embodiment of the platform 150 in FIGS. 10*a* to 10*f*, the means for transfer 156 consists of an actuator pad 152*a* mounted on a rack and pinion system 162. This actuator pad 152*a* is interlocked or secured to the detachable padding 152 by an interlock 160 such that as the rack moves horizontally, the actuator pad 152*a* pushes the padding 152 and the user over to the mobile sitting device 200.

After the padding 150 has reached its intended destination, the interlock 160 is disengaged from the padding and the means for transfer 156 retracted. The interlock 160 is engaged in FIGS. 10*a* to 10*d* and disengaged in 10*e* to 10*f*. Preferably the mobile sitting device 200 contains means for securing the padding 152 in place once the padding and user has been transferred over. This means for securing may include a side panel or latch 250 which blocks the motion of the padding 152 in FIG. 10*a*, lowered in FIG. 10*b* but raised again in 10*f*.

To transfer the user or the padding 152 back to the bed, the process is largely reversed. After successful alignment and berthing, the side panel or latch 250 of the mobile sitting device is release or lowered. As in FIG. 10*g* to 10*h*, the means for transfer 156 extends outward and the interlock 160 engages with the padding 152. The padding 152 is then pulled along the tracks 254, 154 back to the bed. The top of the cushions 102 and padding 152 can then be aligned once again for the comfort of the user to rest upon.

FIGS. 11*a* to 11*g* depict an alternative embodiment of the platform 150 and transfer mechanism 156 in 10*a* to 10*h*. In this embodiment, the transfer mechanism 156 includes a linear piston with an interlock 160 for latching onto a bottom part of the padding 152. The padding is once again mounted on wheels 158 and the process for transferring is generally similar to the previous embodiment except that the transfer mechanism 156 has been changed.

Figure 11A:
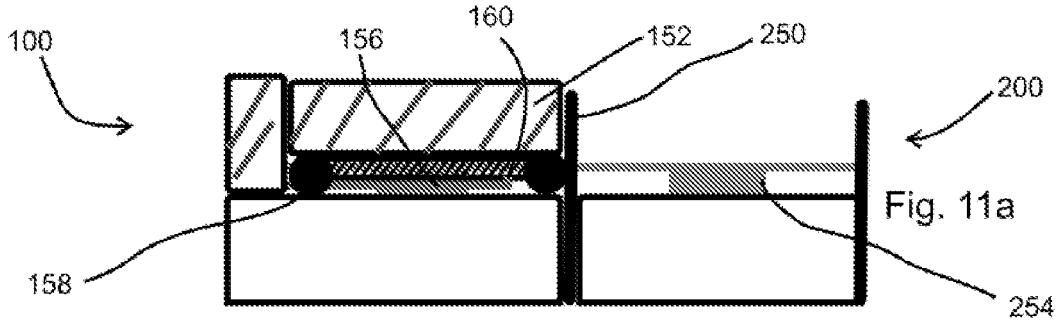
FIGS. 11*a* to 11*g* depict an alternative embodiment of the platform and transfer mechanism shown in 10*a* to 10*h*, according to another exemplary embodiment.
Figure 11B:
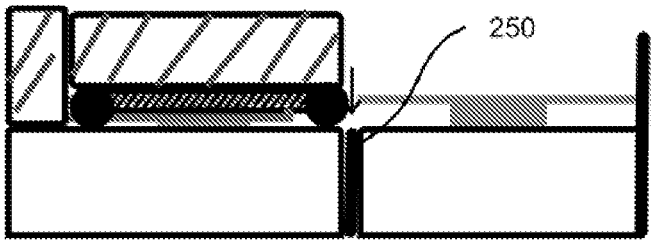
Figure 11C:
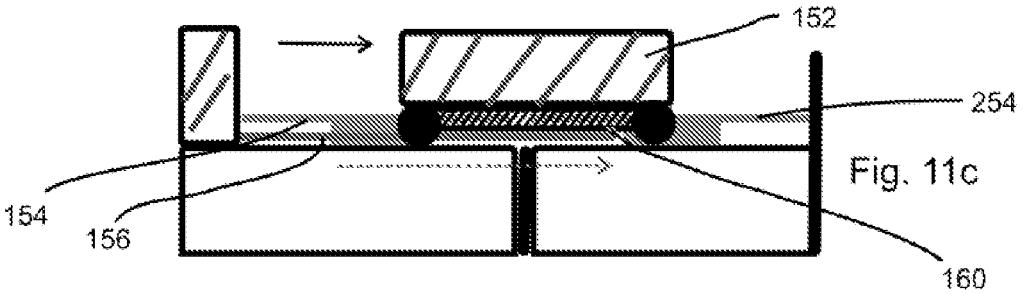
Figure 11D:
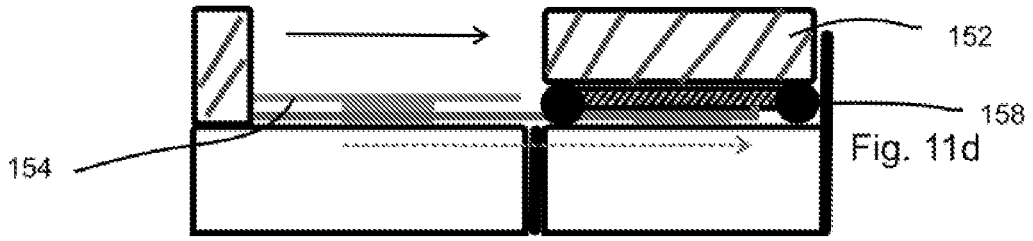
Figure 11E:
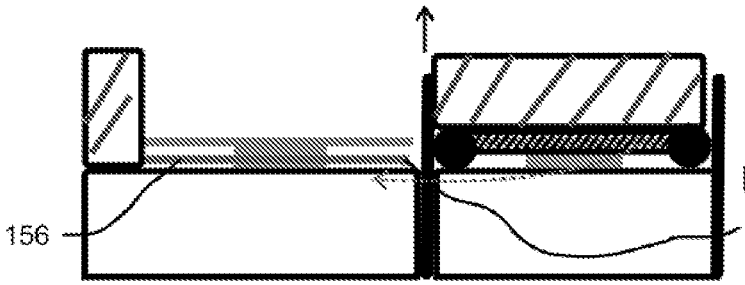
Figure 11F:
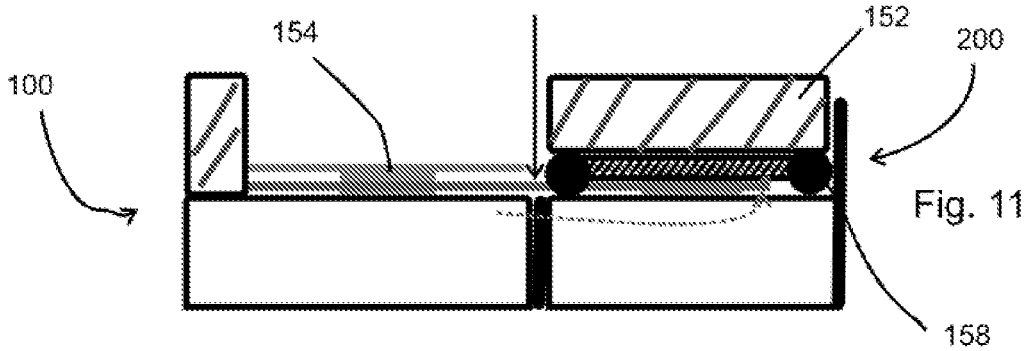
Figure 11G:
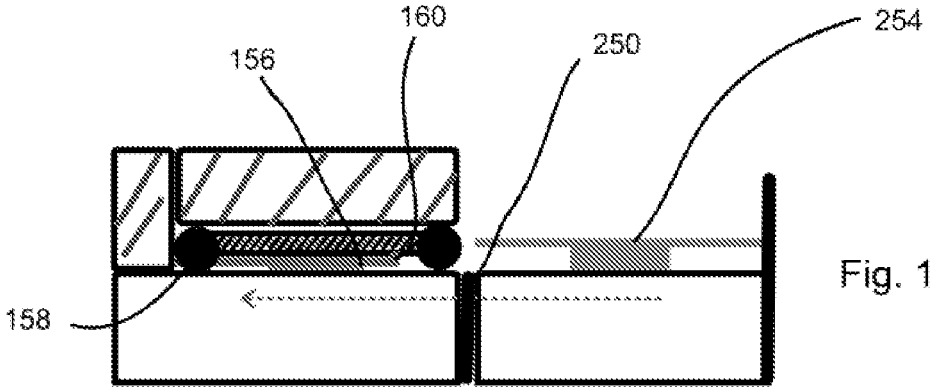

FIG. 11*a* depicts the embodiment with the padding 152 firmly on the bed. In FIG. 11*b*, the side panel or latch 250 of the mobile sitting device is lowered so that the padding 152 can begin to be moved over. In FIGS. 11*c* and 11*d* the linear actuator 156 pushes the padding 152 and the user over to the mobile sitting device 200. In FIG. 11*e*, the interlock 160 is disengaged from the bottom of the padding, the linear piston or transfer mechanism 156 is retracted and the side panel 250 of the mobile sitting device is raised.

To transfer the user and padding 152 back to the bed, the side panel 250 is lowered, the linear piston or actuator 156 is extended, the interlock 160 secures onto the padding 152 and the padding 152 is pulled along the tracks 254/154 back to the bed 100.

FIGS. 12*a* to 12*e* depict yet another embodiment of the patient transfer system similar to the ones in FIGS. 1 and 2, but where there is an additional "variant" type of platform or holder 150*a*.

When transferring from a bed 100 to a chair 200, the foot or leg section 100*a* of the bed often cannot be lowered sufficiently to match the angle of the foot or leg section 200*a* of the mobile sitting device 200 (due to the length of the bed). Thus, rather than let the legs fall sharply down after reaching the edge of the bed 100, a "variant" platform or holder 150*a* is used to support the legs of the user. Similarly, when transferring from the mobile sitting device 200 back to the bed 100, the legs may need to be lifted.

Figure 12A:
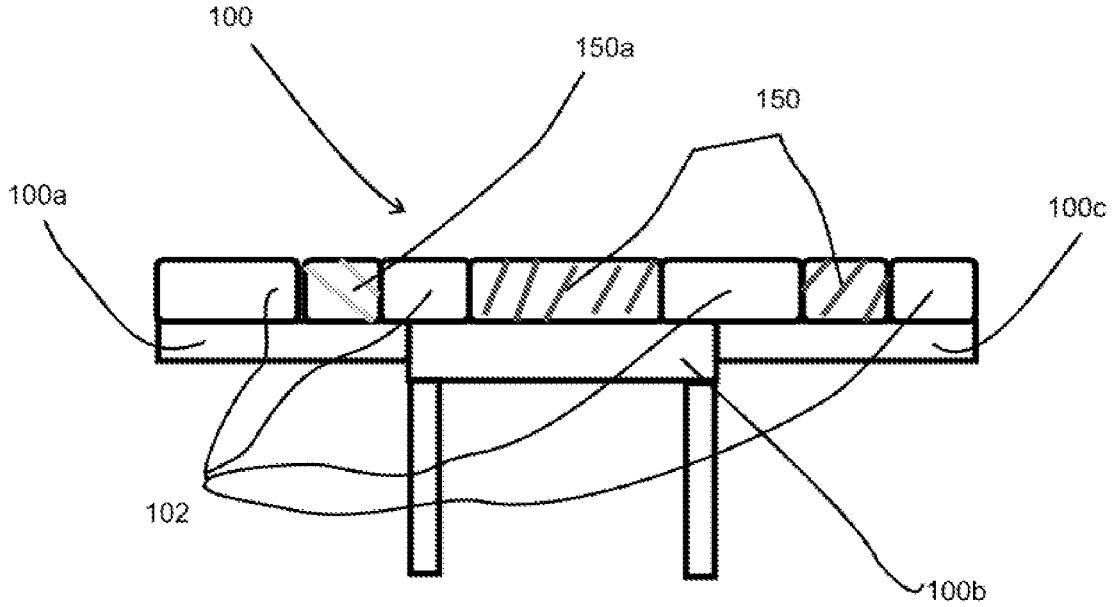
FIGS. 12*a* to 12*e* depict yet another embodiment of the patient transfer system similar to the ones in FIGS. 1 and 2, but where there is an additional "variant" type of platform or holder according to another exemplary embodiment.
Figure 12B:
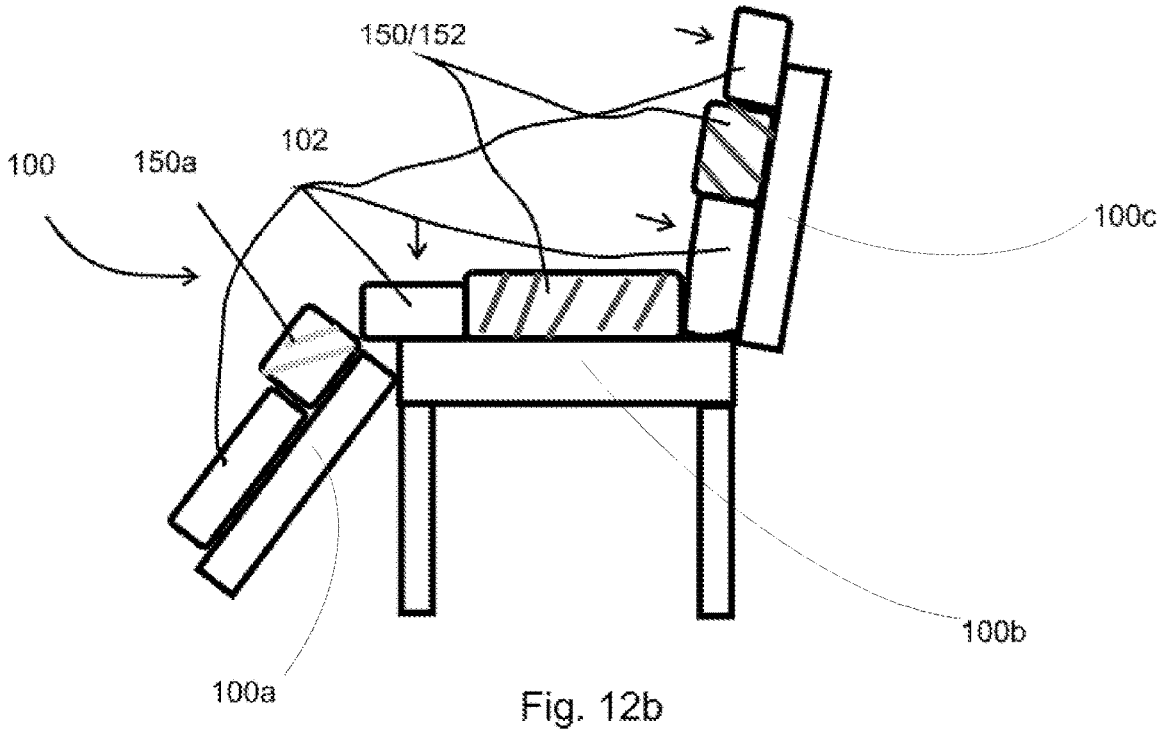
Figure 12C:
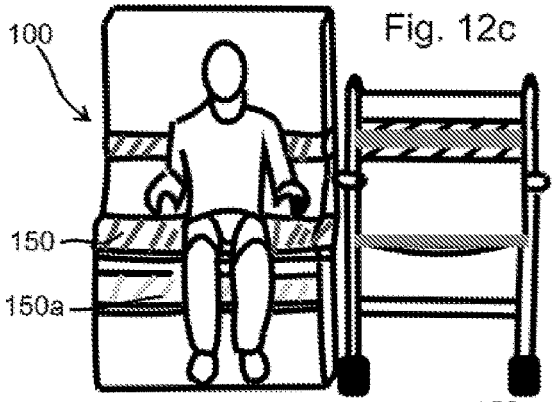
Figure 12D:
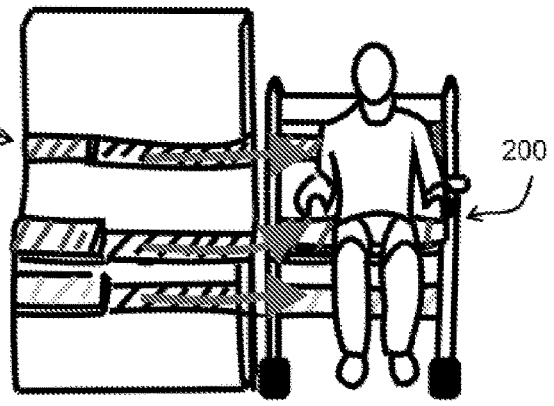
Figure 12E:
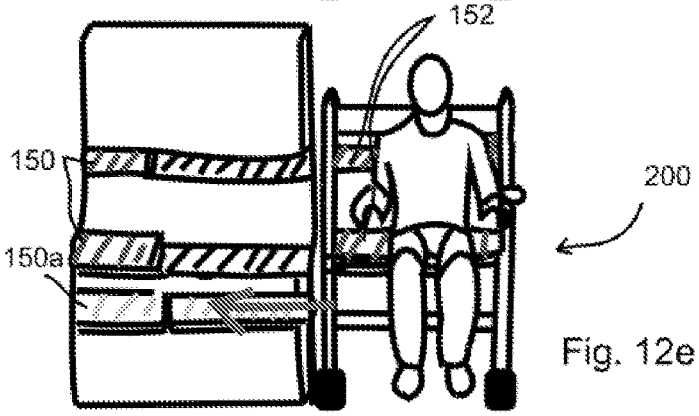

In FIGS. 12*c* to 12*e*, a user is shown being transferred between a bed 100 and a mobile sitting device 200. When the means for transfer 156 is retracted, the padding 152*b* for the variant platform 150*a* is also retracted (unlike the other paddings 152 which stay with the user). Moreover, the padding 152*b* is not only retracted, but its angle, size or position may be altered. An example of the change is better illustrated in FIGS. 13*a* to 13*c*.

When the user is transferred over to the mobile sitting device 200, the legs of the user are generally elevated. Thus, the variant padding 152*b*/holder 150*a* is either expanded or adopts a position where the foot is elevated in FIG. 13*a*. The user's feet are then lowered through the contraction or movement of the variant padding 152*b*/platform 150*a* in FIG. 13*b*. The whole variant padding 152*b*/holder 150*a* is then retracted from behind the lowered legs in FIG. 13*c*. When the user is to be transferred back, the variant padding 152*b* is inserted behind the user's legs, expanded or moved upwards, and then pulled back along with the user.

Figure 14B:
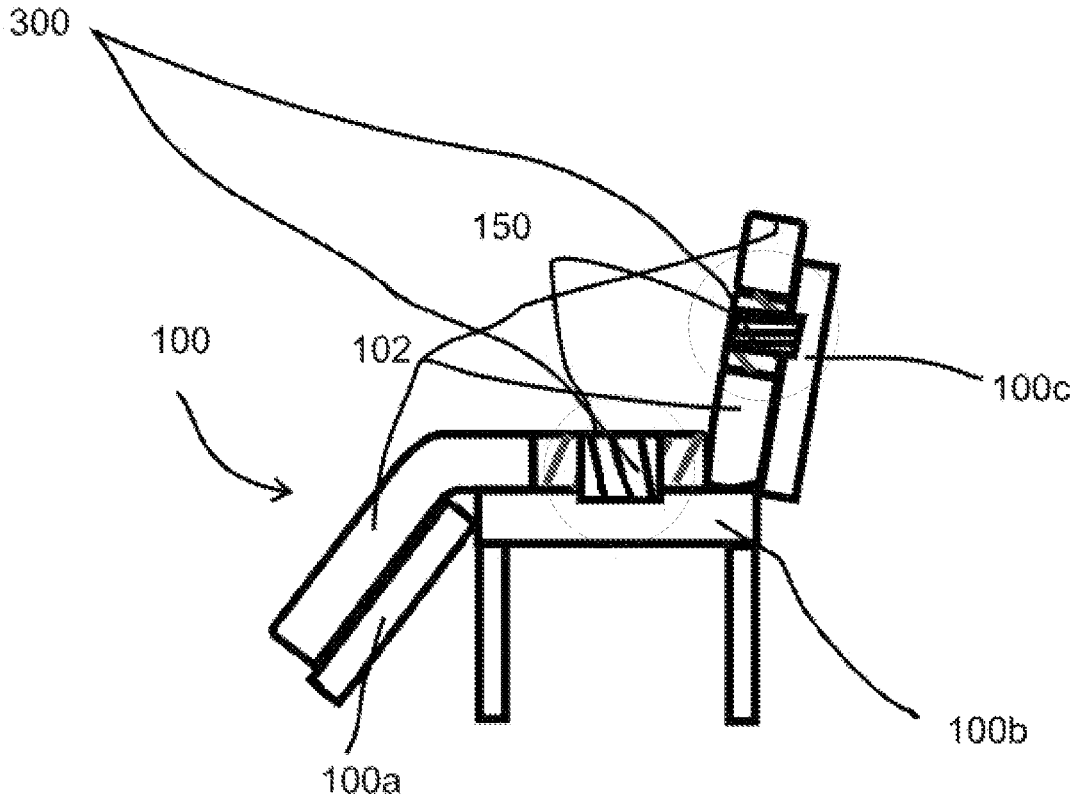
Figure 14C:
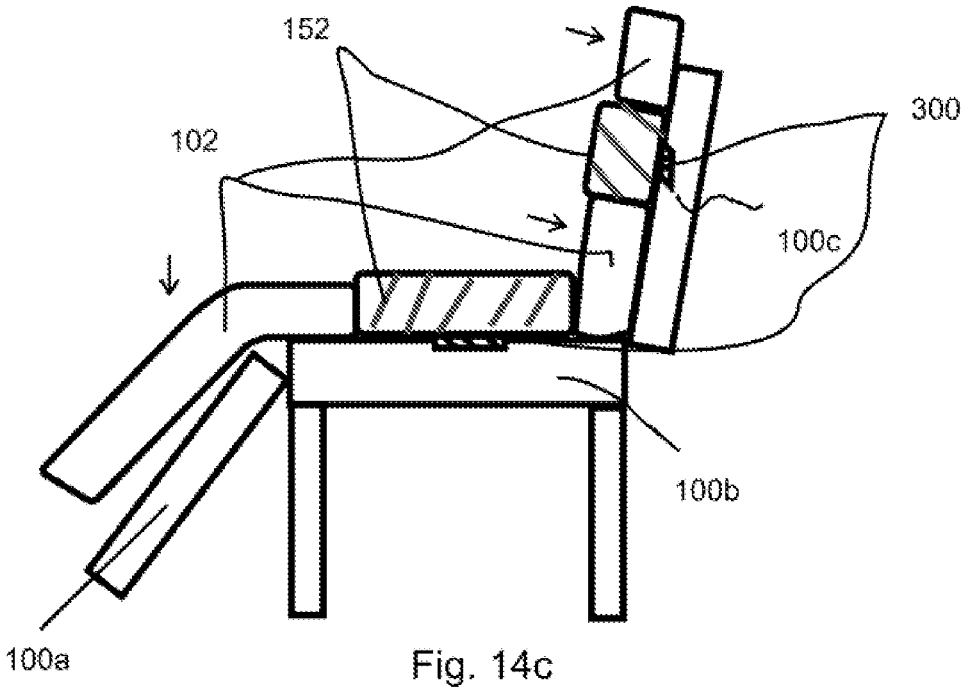

In another aspect of the invention, preferably the padding 152 is perforated to contain holes connecting its front and back surfaces, such that water can pass through the holes and people can bathe on the mobile sitting device 200. Further, in some exemplary embodiments, when the padding 152 is used to lay on the bed 100, the holes are filled such that the laying surface is level and comfortable for people to lay on. This can be done through either physically removing the inlays 300 by hand or through the expansion or contraction of an air bag. It can also be accomplished by lowering the inlays 300 similarly to the cushions in FIG. 3. The process of lowering the inlays is depicted in FIGS. 14*a* to 14*c*. The padding 152 can then be transferred horizontally without interference. In addition, the holes can also be opened through the relative elevation of the padding above the lower cushions or the contraction of an air bag. Moreover, the padding 152 may include a waterproof material.

Figure 15:
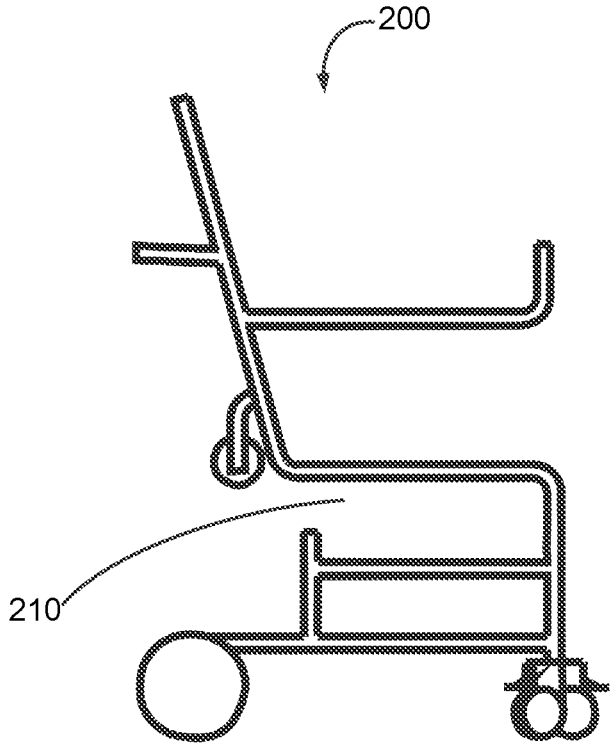
FIG. 15 depicts a lateral view of a mobile sitting device with a C-shaped opening at its back according to an exemplary embodiment.

In another aspect of the invention, preferably the mobile sitting device is a mobile shower chair that can be fitted inside an automatic bathing device (not shown). More preferably said mobile shower chair contains a C-shape opening 210 at its back, as shown in FIG. 15. Optionally the mobile sitting device may also be pushed by an automatic guided vehicle to the automatic bathing device. The mobile sitting device may also be a powered or electric wheelchair.

What is claimed is:

1. A bed, adaptable to a seated arrangement and comprising an interleafing structure of cushions and platforms arranged side-by-side, the platform comprising: a padding, a restricted track, and means for transferring the padding relative to the cushions in a direction parallel to a ground away or towards the bed along the track; and the bed further comprising means to raise a top of the padding;

wherein the bed comprises a first state and a second state; in the first state, the interleaving structure is arranged to create a relatively level top surface between a top of the cushions and the top of the padding which together form a mattress for the bed; in the second state, the cushions and the padding create a gap in elevation such that the top of the padding is above the top of the cushions, and the top of the padding is configured to support weight of a user above the cushions so that the user is able to be transferred sideways while minimizing any friction against the cushions.

2. The bed as claimed in claim 1, wherein the platforms comprise a portion to support a back and a portion to support buttocks.

3. The bed as claimed in claim 1, wherein the cushion or the padding comprises an air cushion, and the means to raise the top of the padding comprise expanding of the air cushion.

4. The bed as claimed in claim 1, wherein the means to raise the top of the padding comprise actuating the padding by a piston or motor.

5. The bed as claimed in claim 1, wherein the means for transferring the padding comprises a rack and pinion system.

6. The bed as claimed in claim 1, wherein the means for transferring the padding comprises a interlock for latching or unlatching onto the padding.

7. The bed as claimed in claim 1, wherein the means for transferring the padding further comprise wheels or rollers for easier movement of the padding.

8. The bed as claimed in claim 1, wherein the means for transferring the padding is retractable after transferring the padding away the bed.

9. The bed as claimed in claim 1, wherein the padding is perforated to contain holes connecting a front surface of the padding and a back surface of the padding.

10. The bed as claimed in claim 9, wherein the holes are filled when the padding is used to lay on the bed, such that a laying surface is level for people to lay on.

11. The bed as claimed in claim 9, wherein the padding comprises a waterproof material.

12. The bed as claimed in claim 1, wherein the bed further comprises a male section or a female section for alignment.

13. The bed as claimed in claim 1, wherein the bed further comprises a holder for supporting legs or feet of the user, the holder comprising means for lifting the legs or feet upward so that it is aligned with a foot portion of the bed or allowing it fall to backwards towards a perpendicular position when the user is transferred to a mobile sitting device.

14. A patient transfer system, comprising:

a bed, adaptable to a seated arrangement and comprising an interleafing structure of cushions and platforms arranged side-by-side, the platform comprising: a padding, a restricted track, and means for transferring the padding relative to the cushions in a direction parallel to a ground away or towards the bed along the track; and the bed further comprising means to raise a top of the padding;

wherein the bed comprises a first state and a second state; in the first state, the interleaving structure is arranged to create a relatively level top surface between the top of the cushions and the top of the padding which together form a mattress for the bed; in the second state, the cushions and the padding create a gap in elevation such that the top of the padding is above the top of the cushions, and the top of the padding is configured to support weight of a user above the cushions so that the user is able to be transferred sideways while minimizing any friction against the cushions.

15. The patient transfer system as claimed in claim 14, wherein the patient transfer system further comprises an alignment system for aligning, locking or berthing a mobile sitting device to the bed in a consistent shape or position.

16. The patient transfer system as claimed in claim 15, wherein the bed comprises an upper body supporting portion, the upper body supporting portion is capable of being elevated until a sensor indicates a back of the upper body supporting portion is aligned properly with the corresponding part on the mobile sitting device.

17. The patient transfer system as claimed in claim 15, wherein the padding is incapable of being moved until at least one sensor indicates the mobile sitting device is aligned properly.

* * * * *